United States Patent [19]

Burian et al.

[11] 4,103,694

[45] Aug. 1, 1978

[54] MANICURING UNIT

[75] Inventors: Paul D. Burian, Elmsford; Arthur T. Sempliner, New York, both of N.Y.

[73] Assignee: Clairol, Inc., New York, N.Y.

[21] Appl. No.: 683,854

[22] Filed: May 6, 1976

[51] Int. Cl.[2] ..... A45D 29/05

[52] U.S. Cl. ..... 132/73.6; 132/76.2

[58] Field of Search ..... 132/73.6, 76.4, 76.2, 132/76.5, 73, 75, 75.3, 75.6, 75.8

[56] References Cited

U.S. PATENT DOCUMENTS

| | | | |
|---|---|---|---|
| 1,666,619 | 4/1928 | Eberhardt | 132/73.6 |
| 2,880,737 | 4/1959 | Tone et al. | 132/73.6 |
| 3,420,250 | 1/1969 | Holmes | 132/73.6 |
| 3,613,696 | 10/1971 | Paule | 132/73.6 |

*Primary Examiner*—G. E. McNeill

*Attorney, Agent, or Firm*—David J. Mugford; George A. Mentis; Samuel J. Duboff

[57] ABSTRACT

A portable, battery-operated manicuring machine is disclosed in which the batteries and the final output shaft are aligned substantially coaxially. The motor and actuating switch are positioned within the housing intermediate the battery chamber and the final drive unit with the motor being radially offset from the axis of alignment of the drive unit, batteries and housing and the switch being positioned diametrically opposite the motor. The drive between the motor and the final output shaft includes a gear reduction train comprising a pinion gear on the motor output shaft, a cluster gear having it's larger-diameter gear in meshing relationship with the pinion gear and its smaller gear in meshing relationship with an internally-toothed gear and the output shaft.

The motor and gear-reduction train are mounted on opposite sides of a bulkhead which is mounted transversely within the forward part of the machine housing. The motor is mounted by means of a pressed fit in the bulkhead and is retained therein by a yoke engaging the remote surfaces of the motor and the bulkhead.

The output speed and the diameter of the manicure accessories are correlated to provide a slow surface speed of the working surface in the order of 23 inches per second. A speed of 360 rpm is preferred as is an outside diameter of 1.20 inches.

14 Claims, 10 Drawing Figures

Fig. 6.
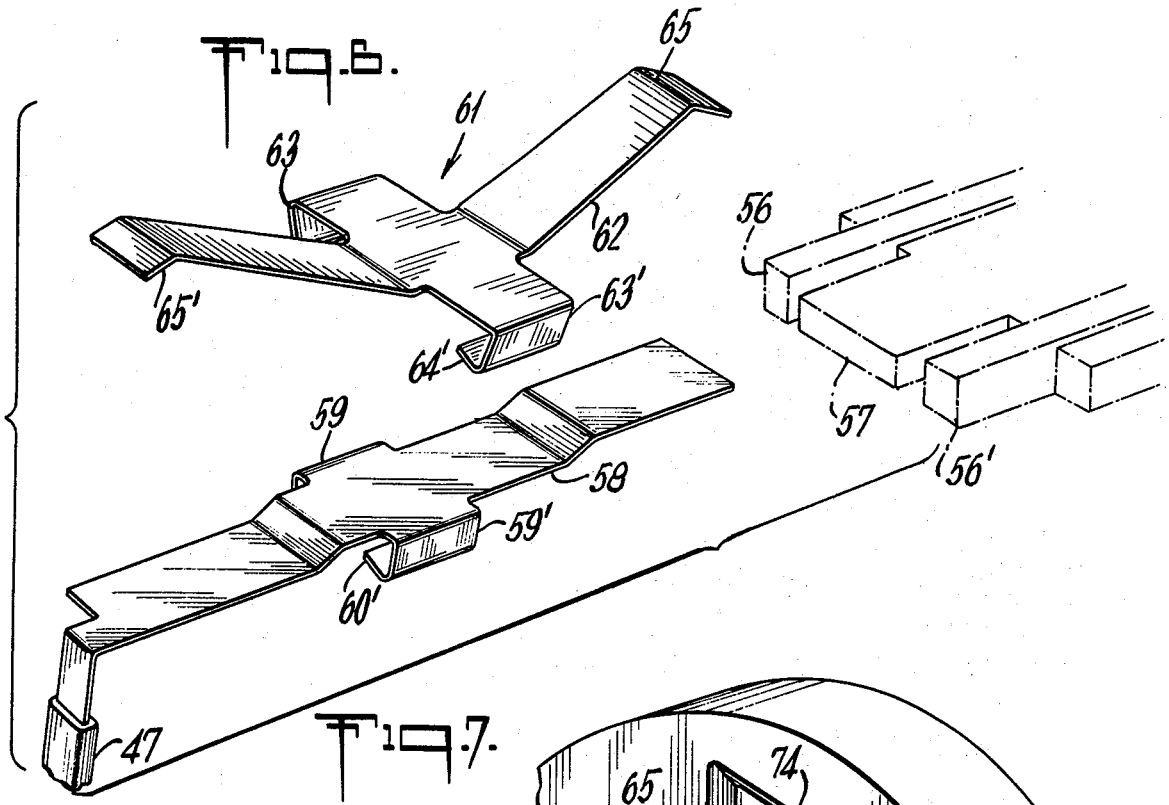
Fig. 7.
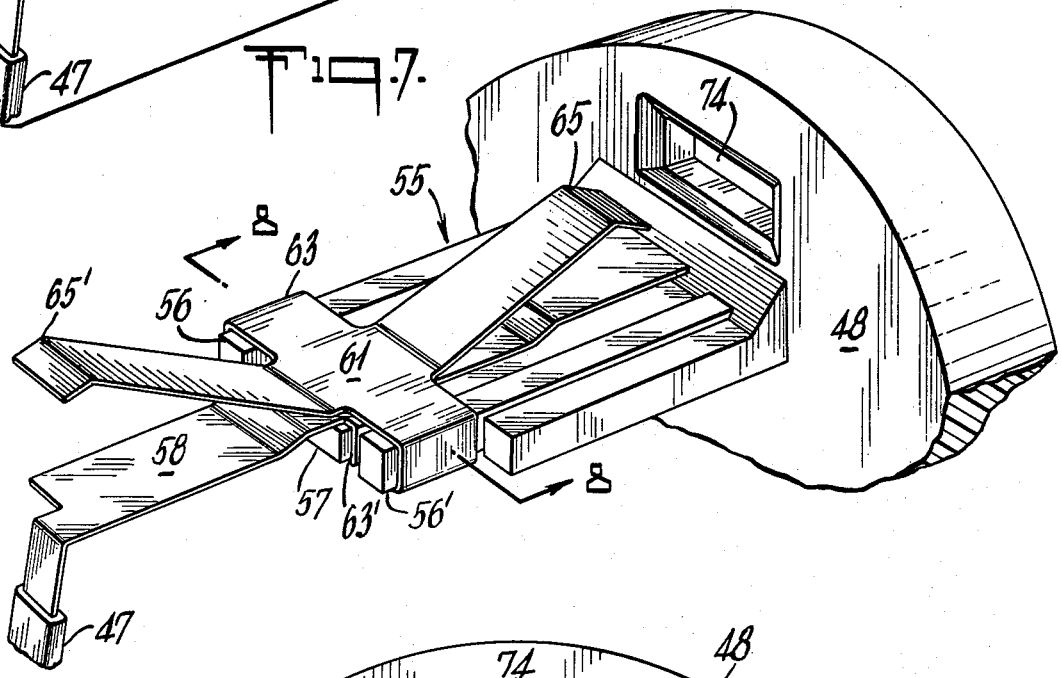
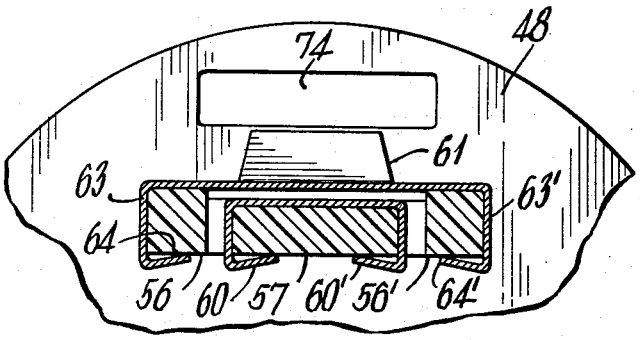
Fig. 8.

MANICURING UNIT

BACKGROUND OF THE INVENTION

The present invention relates to motor driven manicuring machines and is concerned, more particularly, with hand-held, battery-powered abrading and polishing apparatus for grooming nails at low surface speeds.

BRIEF DESCRIPTION OF THE PRIOR ART

A wide variety of attempts have been made for the provision of motor-powered abrading and polishing devices for fingernails and toenails. These have included both manipulable or portable units employing rotary abrading units and larger, static or table-type units.

These latter, table-top units typically are driven electrically and include one or more apertures for providing access and orientation of a fingernail with regard to the abrading surface. Units of this type are effective for the abrasive filing of fingernails but are generally unsuitable for use in grooming or trimming toenails.

Furthermore, these static units tend to be rather large and heavy, so that their use is generally limited to a specific location at which they consume a considerable amount of room on table tops or shelving. Accordingly, although these relatively large units may be constructed with relatively large drives to move the abrading surface at desirable speeds, they are quite limited in their versatility of use, particularly in terms of location and convenience for grooming different types of nails.

Prior forms of small, rotary manicuring units have employed small, high speed motors in order to achieve the desired compactness. Since motor torque is a function of the size of the motor and, especially, since the surface speed of a rotating unit directly related to the tool diameter, for a given speed, the tools or abrasive bits of such prior units typically have been limited in diameter to less than one-half inch.

These prior units have not been well accepted by consumers for several reasons. The very high speeds and the sensible torque reaction have made it quite difficult for an untrained individual to control such units. The tendency is for the abrasive bit to recoil or to run itself away from the nail. This made it almost necessary to provide additional guidance for the controlling hand, such as by the use of a second hand as an additional guiding means. While this is feasible when the units are used by a second person, it is clearly unsuitable when it is desired to use the unit for self-manicure.

These high-speed, small-diameter bits also involve the danger or tendency to groove or to "scallop" the nail if they are presented against the nail with too much force or for too long a time. Therefore, any distraction or inattention frequently would result in the formation of a small-diameter arc-shaped deformation of the nail, in contrast to the desired sculpturing being attempted.

Consequently, prior manicuring units have not been found to be entirely satisfactory.

SUMMARY OF THE INVENTION

In general, the preferred form of the present invention comprises a battery-driven unit in which the motor is offset from the central axis of the unit and engages the output shaft by means of a gear reduction unit which reduces the rotational speed of the output shaft to provide a surface speed of less than 30 inches per second in abrading accessories of diameters not significantly greater than 1.5 inches in diameter.

At a preferred rotational speed of about 360 rpm and with an abrasive accessory having a diameter of 1.20 inches, the manicuring unit of the present invention has been found to overcome the deficiencies of the prior art and to provide an ease of use comparable to the familiar emery board with additional convenience which has not been heretofore available to the consumer.

OBJECTS OF THE INVENTION

It is an object of the present invention to provide a simple and readily controllable power manicuring unit which avoids disconcerting sensations to the user and the potential for small-diameter intrusions into the nail.

It is another object of the present invention to provide a battery-powered manicuring unit which is slim and elongated in shape and which may be held in a variety of positions including that of a pencil.

It is another object of the present invention to provide a battery-powered manicuring unit which has a slim and tapered shape and which employs abrading accessories of diameters approximating the maximum diameter of the unit.

It is another object of the present invention to provide a powered manicuring unit which is unencumbered by a power cord and which is capable of rotating relatively large-diameter accessories at relatively low surface speeds by means of a slim and facile casing enclosing the power source and the drive.

A further object of the present invention is the provision of a battery-powered manicuring unit which mounts a battery source, drive and output shaft on different axes in a slim casing which is convenient for single-handed use.

A further object of the present invention is the provision of a battery-powered manicuring unit which mounts a battery source and the output shaft coaxially with the axis of a slim, rounded housing and which mounts a motor and an operating switch diametrically opposite each other with the shaft of the motor being radially offset from the axis of the housing and the remainder of the components coaxial therewith.

A further object of the present invention is the provision of an unencumbered manicuring unit which is slim in contour and which drives a large diameter accessory at low surface speed and which is capable of use with one hand for grooming toenails.

A particular object of the present invention is the provision of a compact, battery-driven manicuring unit which employs multiple batteries in tandem relationship coaxially with the output shaft and with the housing and which includes a high-speed motor radially offset therefrom with a gear-reduction train in engagement between the motor and the output shaft.

A further particular object of the present invention is the provision of a facile, unencumbered manicuring unit which is economical and which is versatile in the use of quickly-changeable accessories.

It is a further particular object of the present invention to provide a fully portable manicuring unit which provides for low-speed rotation of relatively large-diameter accessories in a slim and convenient housing and with a minimum of complexity of the structure to permit the use of small battery cells and a small diameter motor with a compact gear-reduction train to make possible the use of a slim, tapered casing of a diameter approximating the diameter of the accessory and capable of convenient control with one hand either for grooming fingernails or for grooming toenails with the grooming-control arm fully extended to reach the foot.

BRIEF DESCRIPTION OF THE DRAWINGS

These and other objects of the invention and a better understanding thereof may be derived from the following description and accompanying drawings, in which:

FIG. 6 is an exploded view showing the switch contacts in relation to their mounting projections;

FIG. 7 is a perspective view of the assembled switch;

FIG. 8 is a sectional view taken along the lines 8—8 of FIG. 7; and

DETAILED DESCRIPTION OF THE PREFERRED EMBODIMENT

Figure 1:
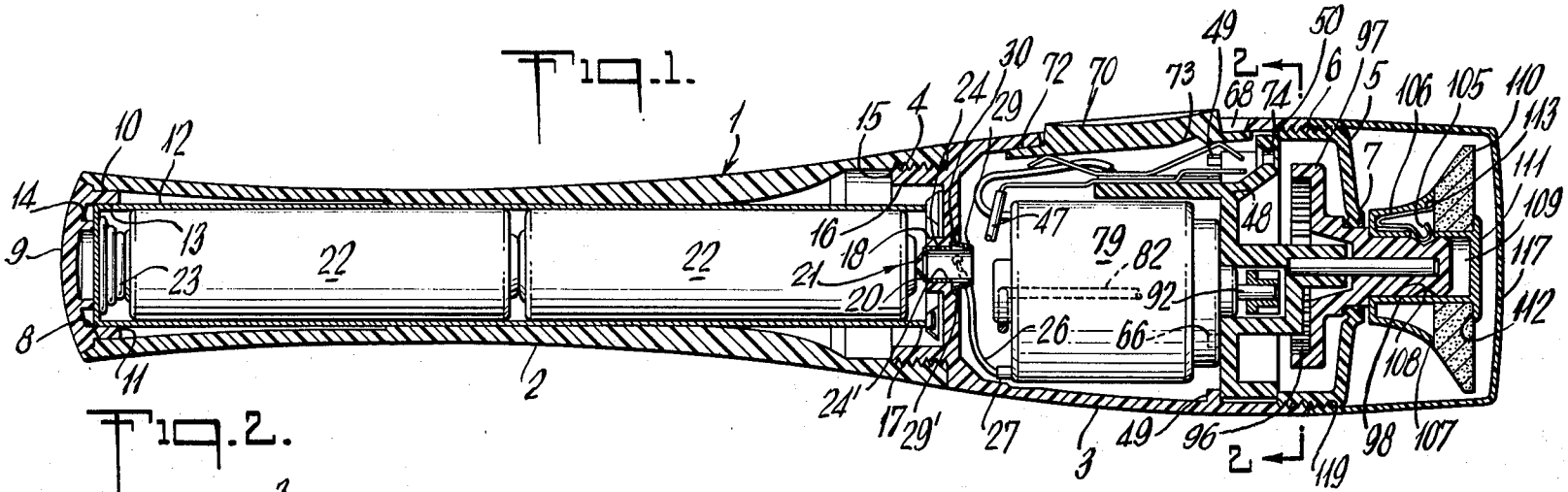
FIG. 1 is a sectional side view of the preferred form of manicuring unit according to the invention.

As shown in the drawings, the preferred form of manicuring unit of the present invention comprises a casing 1 of generally cylindrical cross-section throughout its length and including a handle portion 2 engaging a housing portion 3 by means of a threaded joint 4. The end of the housing remote from the handle 2 is closed by an end member 5 secured therein by a threaded joint 6 and having an axial aperture and a dust seal 7 therein.

The handle 2, housing 3, end member 5 and other exposed portions of the unit preferably are formed of a polyester or another material which is resistant to the solvents normally occurring in manicuring materials, such as nail polish remover.

The handle has a dual taper on its exterior surface, for ease and security of manipulation, and includes an axial bore 8 which is closed at the smaller end of the handle by an end cap 9.

The end cap 9 is suitable secured in the handle, such as by ultrasonic welding, and includes an annular projection 10 which extends into the bore 8 and which includes a chamfer 11 to receive and align the closed end of a battery tube 12 within axial bore 13 of the projection 10. An annular abutment 14 is provided in the bore 13 to engage and establish the longitudinal position of the battery tube 12.

The threaded portion 15 of the housing 3 which forms the threaded joint 4 within the bore of the handle 2 is provided with a cylindrical recess 16 which surrounds the open end 17 of the battery tube 12 when in the assembled position. The housing 3 includes a rectangular boss 18 which is positioned along the common, central axis of the handle 2, housing 3 and battery tube 12 and within the cylindrical recess adjacent the rim 17 of the battery tube 12.

The rectangular boss 18 has an aperture 19 which receives and mounts a contact member 20 therein in a position to engage the positive terminal 21 of the second of two batteries 22. The batteries are biased towards engagement with the contact by means of a conventional spring 23 within the closed end of the tube 12.

The contact member 20 is formed of flat spring stock with four legs 24, 24', 25 and 25' folded back from the central portion 28 with two opposite legs 24 and 24' having angular flanges 29, 29' perforated therein. In position, the angular flanges 29, 29' abut against a recessed face 30 of the housing and serve as retainers for the contact 20. The remaining two legs 25 and 25' of the contact initially extend at right angles to the legs carrying the angular flanges, thereby engaging the surface or face 31 of the boss to retain the contact in position against the bias of the battery spring.

The two legs 25 and 25' of contact bearing against the face 31 of the boss portion are bent into a U-shaped relationship and extend through apertures 32, 32' in the housing wall to a position emergent from the wall adjacent the angular flanges 29 and 29'. One of these emergent contact legs subsequently has a lead wire 26 secured thereto by suitable means such as soldering and which carries a terminal clip 27 for engagement with a motor terminal. The central portion 28 of the contact is ruptured by means of a star-shaped punching 34 to provide four sharp points 35 of contact directed against the battery terminal 21.

Within the recess portion 16, the housing carries a negative contact member 36 which engages the rim 17 of the conductive battery tube 12 and is therefore in electrical communication with the negative terminal of the batteries via the spring 23. The negative contact 36 is formed of flat spring stock with a rectangular aperture 37 positioned centrally therein for receiving the generally rectangular boss 18 in the recess 16. The negative contact has opposed legs 38 and 39 which are bent into U form and which extend through apertures 40 and 41 in the housing wall and carry angular flanges 42 punched therein for engaging and locking against the housing wall 30 to retain the contact in position. The negative contact 36 also includes a pair of L-shaped extensions 43 and 44 on opposite sides of the aperture and which have their terminal portions 45 and 46 extending in opposite directions and bent outward away from the central portion and the bottom wall of the recess, so that they are self-biased into engagement with the rim 17 of the battery tube. A negative lead wire is subsequently secured to one of the legs 38 or 39 of the negative contact, such as by soldering, and is provided with a terminal clip 47.

Adjacent its end remote from the handle 2, the housing 3 carries a transverse bulkhead 48 which is retained against and between a plurality of abutments 49 within the hollow portion of the housing and a shoulder 50 on the threaded end member 5. Preferably, the abutments 49 and formed by a plurality of arcuate ribs which are directed inwardly from the interior wall of the hollow portion of the housing. The bulkhead includes opposed notches 51 and 52 in its periphery and which receive projections 53 and 54, respectively, extended inwardly from the inner wall of the housing to lock the bulkhead against rotation.

The bulkhead has a projection 55 extending rearwardly in the direction of the handle and including a pair of fingers 56, 56' at an upper level and spaced from each other on opposite sides of a lower level, single projection 57. The lower single projection 57 receives and mounts a flatspring stock, static switch contact 58. The static switch contact 58 is a flat, elongated strip carrying a pair of lateral projections 59, 59' which are bent downwardly for a distance and then again bent inwardly toward each other and again upwardly toward the main portion of the strip for their ends 60 and 60' to receive and resiliently engage the lower projection. At its end adjacent the end wall, the static switch contact is bent downwardly and is dimensioned to receive and engage the terminal clip 47. At its opposite end, the static switch contact is bent upwardly and terminates in a plane which is parallel to its original plane and spaced upwardly from the main portion of the rearward projection of the bulkhead.

The paired fingers 56, 56' of the rearward projection of the bulkhead carry a flexible, relatively moveable switch contact 61 which is formed of flatspring stock and which includes a generally elongate main portion 62 having a pair of lateral extensions 63, 63' which are bent downwardly a distance and then toward each other and again upwardly toward the main body portion to span and for their ends 64, 64' to resiliently engage and lock the contact on the spaced fingers 56 and 56'. The opposite ends of the longitudinal main portion of the flexing switch contact 61 are bent upwardly away from the main portion and terminate in short, reversely-bent ends 65 and 65'.

In the region overlying the switch contacts, as viewed in FIG. 1, the housing 3 has an oval button-aperature 68 which is internally surrounded by a generally flattened portion 69 of the inner wall. A button member 70 having a generally oval body 71 surrounded by a flat flange 72 and which tapers inward at its forward and rearward ends is engageable against the flat inner portion of the housing when the button is fully inserted radially outwardly in the oval aperture from within the housing.

Figure 1A:
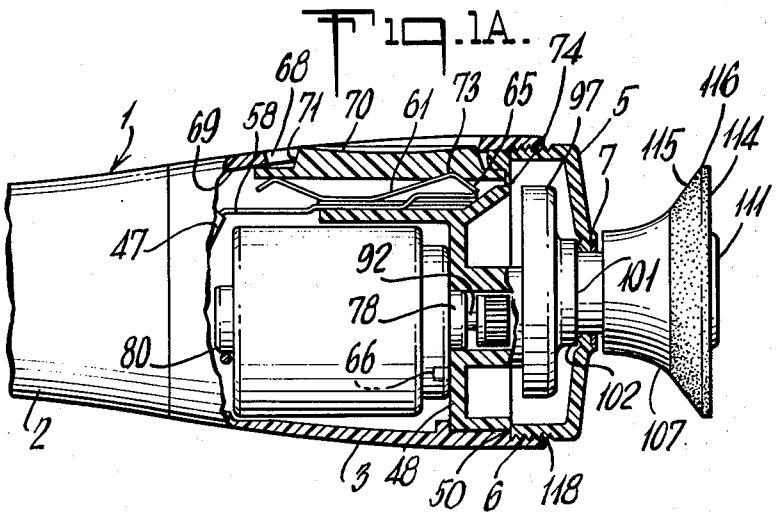
FIG. 1*a* is a view similar to FIG. 1 and showing the manicuring unit in operating configuration.
Figure 2:
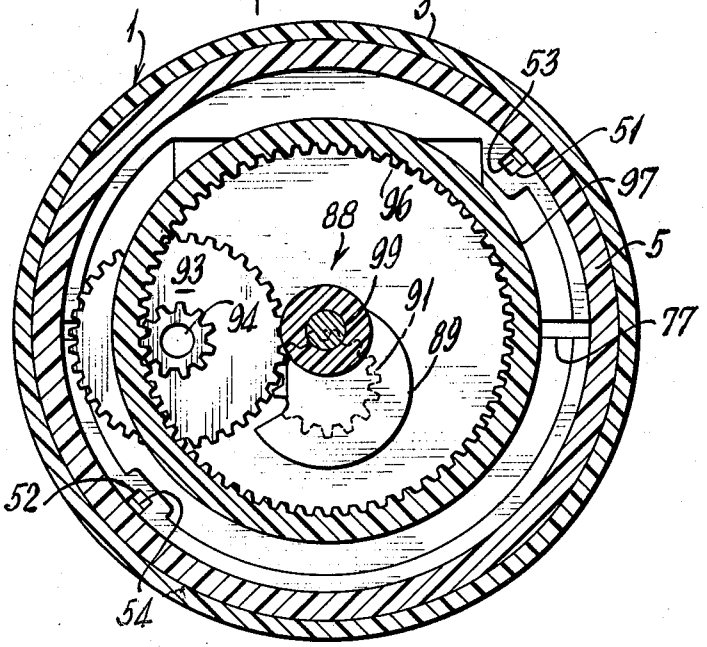
FIG. 2 is a cross-sectional view taken along lines 2—2 of FIG. 1 and showing the gear reduction train.

In its end adjacent the bulkhead, the button has a notch 73 therein which is sized to receive the adjacent angular portion of the moveable switch contact 61 adjacent the reversely-bent end 65 when the button is depressed and moved forward and away from the handle to the "on" position, as best shown in FIG. 1*a*. The bulkhead carries a generally rectangular recess 74 therethrough for receiving the forward edge of the button when the button is thus moved to the forward position.

Diametrically opposite the rectangular aperture 74 and, therefore, the switch assembly, the bulkhead has a cylindrical aperture 76 which is radially offset from the common center line of the housing and the remainder of the unit. Flanking the aperture 76, the bulkhead has a pair of slots 77 and 77' extending chordally from its edge inwardly and aligned with the center line of the offset aperture 76.

The aperture 76 receives the bearing housing 78 of a low-voltage, high rpm motor 79 in a press-fit relationship. The opposite bearing housing 80 of the motor is engaged by a U-shaped portion 81 of a motor-mounting yoke 82 formed of a spring-grade wire and having opposed legs 83, 83' extending forwardly on opposite sides of the motor and through the opposed slots 77, 77' in the bulkhead. The lateral legs 83, 83' each have transverse bends 84, 84' extended toward each other and terminating in rearwardly extending pin-ends 85, 85' which are receivable in a pair of apertures 86 and 86' adjacent the slots 77 and 77'. The motor casing is locked against rotation by a bulkhead pin 66 engaging an aperture 67 in the casing. The motor is, therefore, positioned and supported by both the fit in the aperture 76 and the tension of the yoke. Preferably, the slots 77 and 77' are tapered downwardly, as at 87, away from the center line of the bulkhead to permit the yoke to swing downwardly for insertion of the motor.

Figure 3:
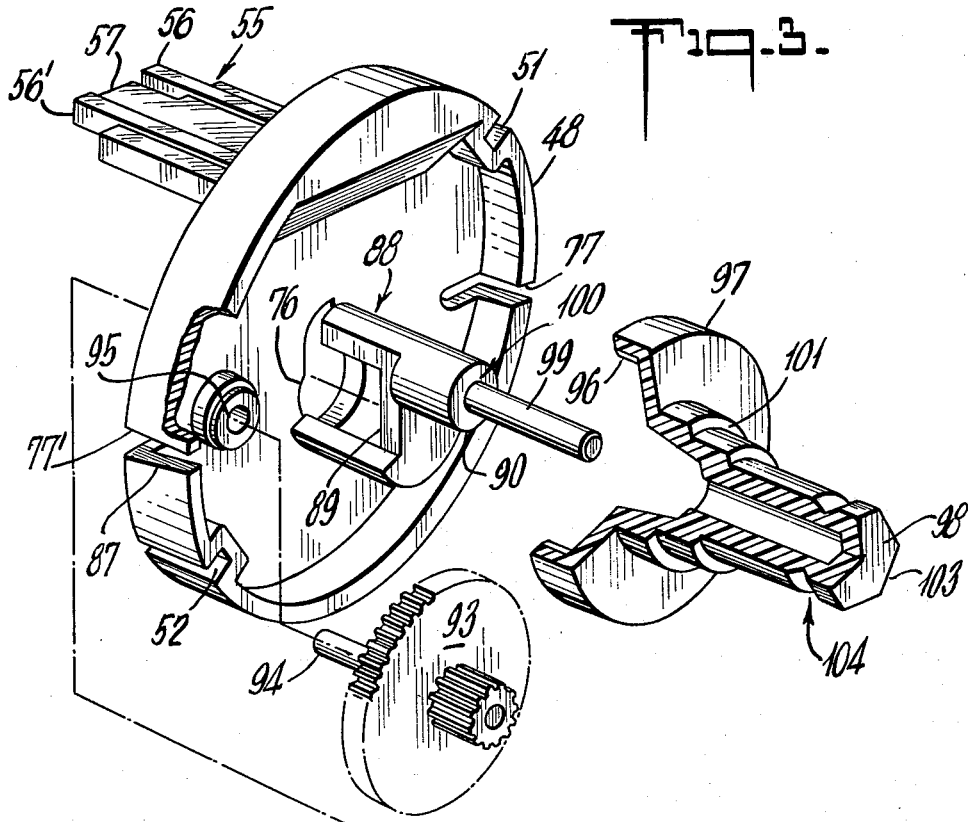
FIG. 3 is an exploded view of the motor and gear train and viewed from a perspective point to the left of FIG. 2.
Figure 9:
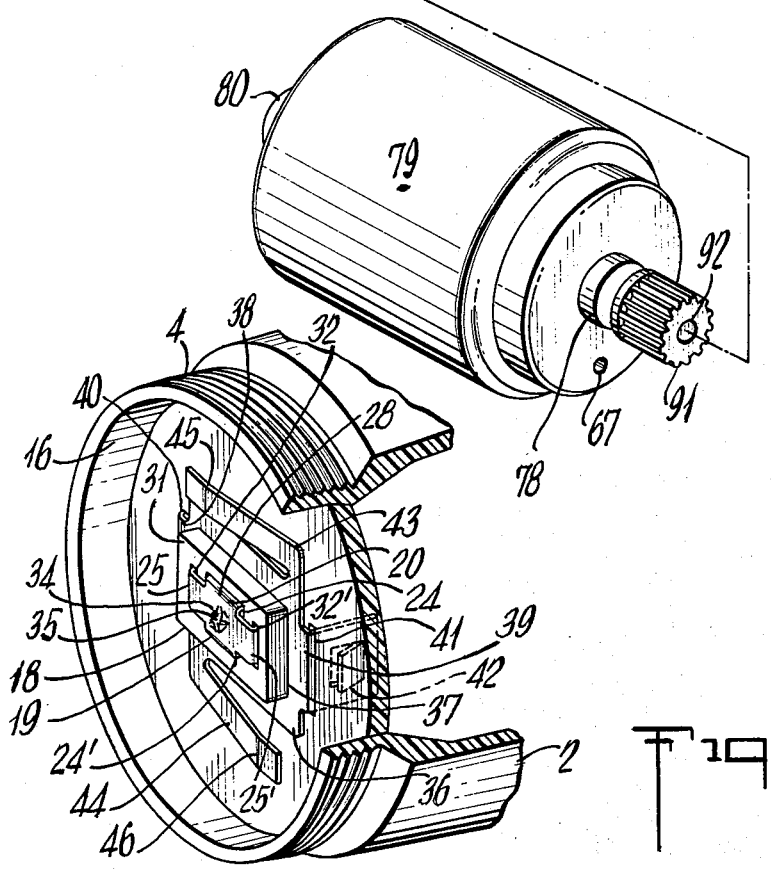
FIG. 9 is a perspective view of contacts for engaging the batteries and the wall upon which the contacts are mounted.
Figure 4:
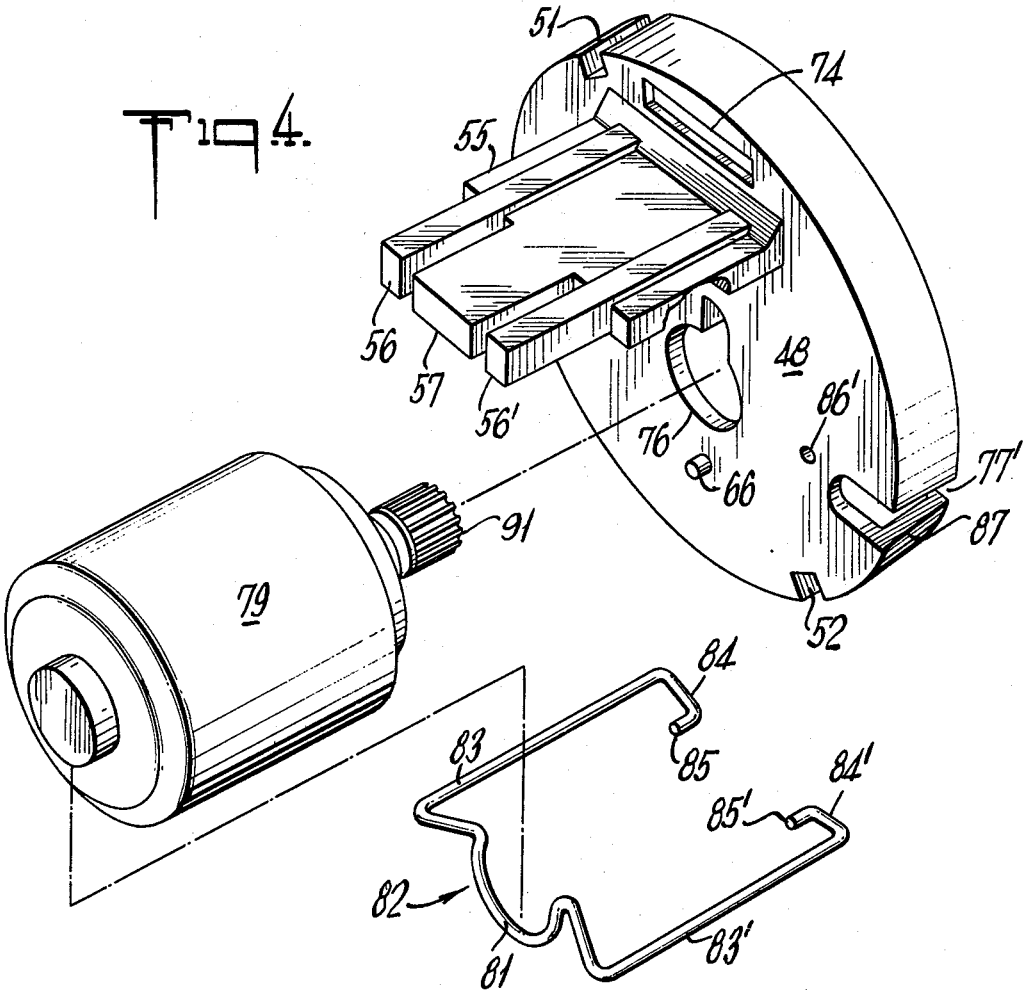
FIG. 4 is an exploded view of the motor and its mounting and viewed from a perspective point rearward from that of FIG. 3.
Figure 5:
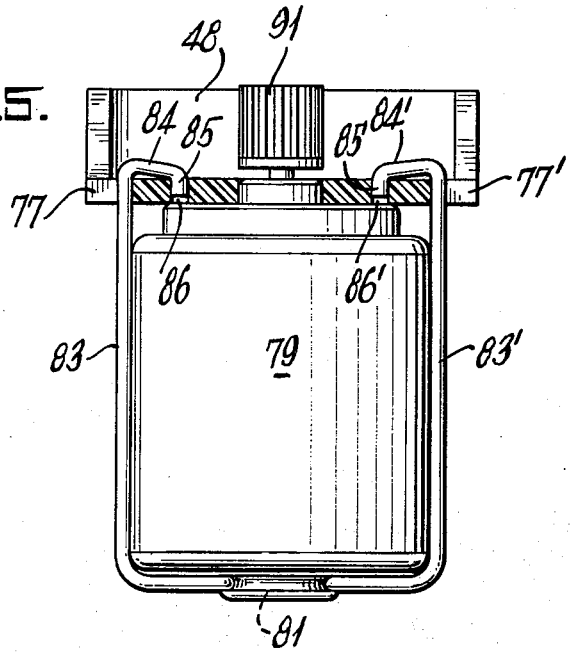
FIG. 5 is a plan view, partly in section, of the structure of FIG. 4.

On its side opposite from the motor 79, the bulkhead carries a forward extension 88 which includes a generally cylindrical gear chamber 89, formed as an extension of the aperture 76, and an axle extension 90 which is coaxial with the housing and the remainder of the assembly. As best shown in FIG. 3, the forward extension 88 is partially cut away along the cylindrical gear chamber 89 to provide access to a pinion gear 91 mounted on the motor shaft 92 therein. A cluster gear 93 is mounted on a pin 94 pressed in a recess 95 in the bulkhead and located to provide engagement of the larger of the cluster gears with teeth of the pinion gear 91. The smaller of the cluster gears is thus positioned to engage the internal teeth 96 of an integral output gear 97 and output drive shaft 98 which is journalled on a pin 99 pressed into a recess 100 in the axle extension 90 and coaxial with the remainder of the unit. The pinion 91, cluster 93 and internally-toothed ring gear 97, therefore, form a gear reduction train which reduces the speed of the output shaft by a ratio of 17 to 1 from the relatively high speed low torque output of the motor, and therefore, provide a shaft output speed in the range suitable for manicuring service, as discussed more fully hereinafter.

The output shaft 98 has an annular shoulder 101 which is positioned to engage a ring 102 on the end wall 5, to limit outward travel of the gear and shaft unit. In service, the pin 99 acts as a thrust bearing when pressure is applied along the output shaft.

The output shaft 98 is hexagonal in cross-section and has flats 103 to provide driving abutment with abrading and polishing accessories, each of the flats 103 having a detent 104 for receiving the locking leg 105 of a generally V-shaped retainer-spring 106 within an accessory adapter 107 which is thereby removeably positioned on the output shaft. The accessory adapter 107 includes a hexagonal bore 108 for receiving and engaging with the flats 103 of the output shaft and includes a forwardly extending cylindrical portion 109 for receiving an abrading or polishing unit 110. A button seal 111 having a flange 112 bearing against the forward surface of the abrading unit 110 secures the unit 110 against a forward-facing shoulder 113 on the accessory adapter 107 and is secured to the cylindrical portion 109, such as by ultrasonic welding.

The preferred form of abrading accessory shown in FIG. 1 includes a substantially flat, radial forward face 114 and a generally conical rear face 115 which converge toward a thin, generally cylindrical, peripheral surface 116, all of which may be used in the grooming procedure, as desired.

A generally cylindrical cover 117 is provided to enclose the final drive and accessory during periods of nonuse and engages an annular shoulder 118 on the housing end wall 5 by means of a plurality of circumferentially-spaced, inwardly-extended raised portions 119.

ASSEMBLY OF THE PREFERRED EMBODIMENT

In assembly of the unit, the positive and negative contacts 20 and 36 are positioned upon the housing and are locked in their appropriate positions by the angular flanges 29 and 42.

With the yoke positioned on the bulkhead and lowered against the tapers 87 of the slots 77, the cluster gear is then positioned on its mount on the bulkhead and the motor, with the pinion gear mounted on its shaft, is subsequently pressed into the aperture, with the cluster gear being rotated as required to provide proper meshing with the pinion gear. The U-shaped portion of the yoke is then snapped onto the closed bearing of the motor.

The static switch contact 58 is then locked upon the lower, single-extension 57 of the bulkhead projection and the moveable switch contact 61 is locked on the spaced fingers 56, 56'. The negative motor terminal is then secured to the moveable switch contact 61 by means of a suitable wire.

Upon completion of the bulkhead assembly with its motor, drive and switch mechanism, the resultant bulkhead subassembly is associated with the housing; the positive motor terminal is connected to the central contact terminal clip 27, and the negative terminal clip 47 is connected to the static switch contact 58. The switch button is then inserted in the housing in a position in which it is fully extended through its aperture, and the bulkhead and its assembly are then inserted in the housing, with the moveable spring contact thereafter engaging with and maintaining the proper positions of the switch button. The end wall 5 is then threaded into the housing and completes the housing assembly.

The handle portion of the casing is then assembled with its end cap and receives the battery tube mounted in the recess in the end cap. After insertion of the batteries, the handle assembly is threaded upon the threaded portion of the housing.

OPERATION OF THE PREFERRED EMBODIMENT

With the unit thus assembled with its batteries, an accessory is selected and installed on the output drive shaft by a simple sliding action therealong until the locking leg of the detent spring 106 engages a notch 104 on one of the flats 103 of the output shaft.

Upon depression of the button 70, the moveable spring contact 61 then is flexed into engagement with the stationary contact 58 and closes the circuit to drive the motor. The depressed button is thereafter moved forward to a position in which its recess 73 engages the angular portion of the flexed spring and its forward edge is received within the recess 74 of the bulkhead. During the sliding motion, the angular portion of the flexing contact 61 is flexed open against the stationary contact 58, until it is received within the button notch 73, at which point it then springs back to its original shape, with the consequent relative motion between the moveable and stationary contacts thus providing a wiping action which serves to maintain a clean contact area between the two contacts.

With the switch locked in the on position and the button flange secured in the recess of the bulkhead, the manicuring unit may then be held or supported from any portion of its casing, without concern for the position of the button and without the need for any continued finger pressure upon the switch button. Thus, the unit may be oriented in any desired angle with regard to the nails to be groomed. This capability is of special advantage in cases in which the unit is to be used by an individual on the individual's own body, which is expected to be a major area of service of the new manicuring unit.

The grooming of the nails may progress through a series of successive operations such as coarse filing, fine filing and buffing, with a simple interchange of the accessories, while the switch is off, in between the successive grooming stages. It is to be understood that a variety of accessories may be associated with the manicuring unit including coarse abrading heads, fine abrading heads, buffing surfaces, or the like and in a wide variety of shapes and diameters.

In this respect, it should be noted that the provision of the gear reduction train, between the high rpm battery-motor and the ultimate accessory surface, provides the desired peripheral speed of the working surface of the accessory, thereby limiting the rate of abrasion or buffing to a comfortable level at which unskilled individuals may readily employ the manicuring unit without the assistance of other persons and without the probability of damage as a result of their initial lack of skills in its use.

It has been found that the working-surface speed of the abrading or polishing surface is to be limited to a maximum of about 30 inches per second for acceptable control by the average human. The preferred range of surface speeds, in terms of facility of use and control, has been found to be that of from minimal speed to an initial maximum of 20 to 25 inches per second in the absence of a load. Under working load, of course, a reduction of this initial maximum speed will occur and will provide a working speed of about 15 to 20 inches per second, depending upon the pressure with which the surface is applied against a nail.

The low rpm output, of about 360 rpm, which is achieved with the manicuring unit of the present invention, in conjunction with the preferred, relatively large-diameter accessories, in the range of 0.75 to 1.5 inches diameter, thus provide the desired surface speeds of the working surface.

It will be apparent that the surface speed of the conical rear face 115 and the radial forward face 114 of the preferred accessory shown in FIG. 1 will vary from the periphery toward the center, so that a range of abrading speeds will be available to the user.

However, with the preferred outer diameter of about 1.20 inches and the speed of 360 rpm, the no-load surface speed of the outer edge 116 is about 23.5 inches per second, which has been found to be an especially effective surface speed and an excellent combination of rotational speed and tool diameter.

It is to be understood that the accessories may have a full, forward working face, unobscured by a button 109, which will provide a range of surface speeds from the desired maximum down to a very low minimum immediately adjacent the center of the face. This structure is considered to be of especial value for polishing.

However, for "filing" purposes, the thin-periphery abrading wheel shown in FIG. 1 is considered to be of special advantage, since it provides for use of the wheel beneath the edge of the nails for perfection of the manicure by removal of any burrs or undesireable edge forms which may be encountered. The thin peripheral edge 116 intermediate the radial and conical faces thus provides an abrasion-filing tool which may be used with great visibility on the several areas and surfaces of the nail without the need for frequent exchange of tools between the surfaces.

Furthermore, the facility of use of the new manicuring unit and the nature of the preferred abrading accessory make it possible to apply any of the working surfaces to the nail without changing the direction of filing and the attendant risk of provoking splitting of the nail. Accordingly, any of the three working surfaces may be oriented to engage the nail in the desired direction, whether by inversion or reversing of the unit or by re-orientation of the nail itself with regard to the position in which the tool is held.

It is to be understood that the present invention is not to be construed as being limited in all its aspects to any specific shape of accessory. However, it is important to the present invention that the accessories have an outer diameter of the working surface which is at least 0.75 inches and not substantially exceeding 1.5 inches, while a working surface diameter of about 1.20 inches is preferred.

Accordingly, it is apparent that the present invention provides for self-manicuring with rotating accessories which are of sufficient diameter to avoid the undesirable consequences of prior units, such as grooving or scalloping of the nails, and at working-surface speeds which are both comfortable and easily controlled by the user.

The coaxial relationship of the casing and working accessory further provides an extremely facile unit which is so easily grasped and controlled that it is quite suitable for self-manicure of toenails without requiring contortion of the individual's body.

Therefore, the present invention provides an especially advantageous manicuring unit and system which avoids the disadvantages of the prior art units and which affords easy and accurate, one-handed control which has been unattainable heretofore.

It is to be understood that the term "manicuring", as used herein and in the appended claims, is applicable to the nails of both the hand and the feet and that the term has been so employed to avoid unnecessary repetition and profusion.

Various changes may be made in the details of the invention, as disclosed, without sacrificing the advantages thereof or departing from the scope of the appended claims.

What is claimed is:

1. A portable manicure unit comprising
(a) a battery source,
(b) a battery-driven motor,
(c) a gear-reduction train and
(d) a manicuring tool rotatably driven by said motor via said gear-reduction train,
(e) said manicuring tool having an abrading working surface having a diameter of at least 0.75 inches and not substantially exceeding 1.5 inches, and
(f) said motor and said gear reduction train being correlated with the diameter of said manicuring tool to provide said working surface speed not substantially exceeding 30 inches per second, whereby said manicuring unit with said large-diameter, low-speed working surface is easily controlled and capable of use in self-manicuring while avoiding undesirable consequences, such as scalloping.

2. The portable manicure unit of claim 1 in which said working surface has a maximum diameter substantially equal to 1.2 inches.

3. The portable manicure unit of claim 1 in which said motor and gear-reduction train are correlated to provide a working surface speed substantially equal to 23 inches per second.

4. The portable manicure unit of claim 3 in which said working surface has a maximum diameter substantially equal to 1.2 inches.

5. The portable manicure unit of claim 4 in which the manicuring tool includes both peripheral and radial working surfaces.

6. A portable manicure unit as set forth in claim 1 including
(a) an elongated casing
(b) an output member at a first end of said casing and mounted for rotation on an axis substantially coaxial with the longitudinal axis of said casing,
(c) said battery source being positioned in said casing adjacent the second end thereof, said battery source including
(d) at least one elongate battery assembly positioned with its longitudinal axis substantially coincident with the axes of said casing and said output member and
(e) said battery-driven motor being positioned in said casing intermediate said battery source and said output member and mounted with its shaft radially offset from the axis of the casing.

7. A portable manicure unit of claim 6 in which said casing is substantially circular in cross-section throughout its length.

8. The portable manicure unit of claim 7 including a switch in said casing positioned generally opposite said motor.

9. The portable manicure unit of claim 6 in which said motor and said gear-reduction train are correlated to provide an output member speed substantially equal to 360 rpm.

10. The portable manicure unit of claim 9 in which said gear train includes a pinion gear on said motor, an internally-toothed ring gear coaxial with and in direct-drive relationship with said output member, and intermediate gear means in driving engagement between said pinion gear and said ring gear.

11. The portable manicure unit of claim 10 in which the intermediate gear means comprises a cluster gear having a major gear in meshing engagement with the pinion gear and a minor gear in meshing engagement with the ring gear.

12. The portable manicure unit of claim 11 in which said ring gear is an integral part of the output member said output member is mounted upon a pin axle, and said casing has an end member surrounding said output member and having confining means for confining axial motion of said output member.

13. The portable manicure unit of claim 12 in which said confining means includes a ring positioned to engage said output member.

14. The portable manicure unit of claim 11 in which said output member includes a drive portion and including a manicuring tool having a surface complementary to said drive portion, and means for releasably retaining said manicuring tool on said drive portion.

* * * * *